US006582797B1

(12) United States Patent
Gunter et al.

(10) Patent No.: US 6,582,797 B1
(45) Date of Patent: Jun. 24, 2003

(54) CARPET FRINGE AND METHOD OF APPLYING SAME

(75) Inventors: Mark J. Gunter, Dalton, GA (US); William H. Swafford, Jr., Dalton, GA (US)

(73) Assignee: Springs Industries, Inc., Fort Mill, SC (US)

( * ) Notice: Subject to any disclaimer, the term of this patent is extended or adjusted under 35 U.S.C. 154(b) by 117 days.

(21) Appl. No.: 09/680,602

(22) Filed: Oct. 6, 2000

(Under 37 CFR 1.47)

(51) Int. Cl.[7] ..... D04D 5/00; D04D 7/08

(52) U.S. Cl. ..... 428/123; 428/115; 428/83; 428/88; 428/122; 428/52; 16/4; 16/8; 112/409; 52/287.1; 52/273

(58) Field of Search ..... 428/115, 83, 88, 428/122, 123, 52; 112/409; 16/4, 8; 52/273, 287.1; 15/215

(56) References Cited

U.S. PATENT DOCUMENTS

| | | | | | |
|---|---|---|---|---|---|
| 122,933 | A | | 1/1872 | Beardsley | |
| 169,993 | A | | 11/1875 | Hirner | |
| 621,089 | A | * | 3/1899 | Howe | 139/385 |
| 1,082,837 | A | | 12/1913 | Whittall | |
| 1,710,595 | A | | 4/1929 | Taylor | |
| 2,001,527 | A | | 5/1935 | Davison | 28/1 |
| 4,054,698 | A | | 10/1977 | Hamrah | 428/40 |
| 5,157,804 | A | * | 10/1992 | Williams | 15/161 |
| 5,589,027 | A | | 12/1996 | Thornton et al. | 156/304.4 |
| 5,683,780 | A | * | 11/1997 | Rodger et al. | 428/95 |
| 5,876,535 | A | | 3/1999 | Moulavi | 156/88 |
| 6,093,469 | A | | 7/2000 | Callas | 428/95 |

* cited by examiner

*Primary Examiner*—Terrel Morris
*Assistant Examiner*—Jennifer Boyd
(74) *Attorney, Agent, or Firm*—Sutherland Asbill & Brennan LLP

(57) ABSTRACT

A fringe treatment for the edge of a carpet. The fringe treatment may include a glide and a fringe. The glide may have a substantial U-shape such that the glide can accommodate the edge of the carpet. The fringe may include a base portion attached to the glide and a number of tassels connected to the base portion.

13 Claims, 3 Drawing Sheets

CARPET FRINGE AND METHOD OF APPLYING SAME

TECHNICAL FIELD

The present invention relates generally to a carpet treatment and more particularly relates to an attachable fringe treatment for use with a carpet of any length or width.

BACKGROUND OF THE INVENTION

Carpet manufacturers, distributors, retail outlets, and others may offer carpets that are sized according to the customer's specifications. For example, a particular carpet design may come on a large bolt of carpeting with a fixed width. A particular carpet segment then may be cut to the desired length. Segments of any length may be cut.

Once the carpet segment has been cut, a fringe or some other sort of a binding is generally applied to the cut ends. Failure to bind the cut ends may result in the ends fraying or unraveling further, the appearance of the carpet with the cut ends may not be acceptable to the consumer. In the past, the cut ends have been sewn, taped, or otherwise mechanically bound. Further, fringe treatments of various types have been sewn onto the cut ends.

None of these applications, however, has been satisfactory in terms of both appearance and timing. For example, while a carpet with sewn ends may have a satisfactory appearance, it may take a significant amount of time to bind the carpet ends. Likewise, carpet tape or similar binding means may be relatively easy to apply, but the final appearance may not be satisfactory to the consumer. Further, the tape may wear out or fray over time and need to be replaced.

What is needed, therefore, is a carpet fringe treatment that can be applied to the cut ends of a carpet segment in both a fast and an attractive manner. Further, the carpet fringe treatment should be reasonably priced, easy to use, and have a useful lifetime similar to that of the carpet segment.

SUMMARY OF THE INVENTION

The present invention thus provides a fringe treatment for the edge of a carpet. The fringe treatment may include a glide and a fringe. The glide may have a substantial U-shape such that the glide can accommodate the edge of the carpet. The fringe may include a base portion attached to the glide and a number of tassels connected to the base portion.

Specific embodiments of the present invention may include a glide with a first arm and a second arm. The fringe may be attached to the first arm of the glide. A second fringe also may be attached to the second arm of the glide. The first arm and the second arm each may have a width of about one to two inches. The width of the second arm of the glide may be greater than the width of the first arm. The fringe may cover the first arm of the glide. The glide may be made out of a thermoplastic.

The fringe may be fixedly attached to the base via an adhesive or removably attached via hook and loop fasteners. The fringe may be made out of polyester. The fringe may include a first end portion and a second end portion. The end portions may have a length of tape thereon such that the end portions can fold over the glide and be attached thereto.

A further embodiment of the present invention may provide for a carpet. The carpet may include a section of carpet material with a first cut end and a second cut end. A fringe treatment may be removably attached to the cut ends of the carpet section. The fringe treatment may include a glide for mating with the cut ends of the section and a fringe. The fringe may include a base portion attached to the glide and a number of tassels connected to the base portion. The glide may include a substantial U-shape. The fringe may be fixedly attached to the base portion via an adhesive. The fringe may include a first end portion and a second end portion. The end portions of the fringe may have a length of tape thereon such that the end portions can fold over the glide and be attached thereto.

The method of the present invention provides for covering the cut ends of a carpet segment with a fringe treatment. The fringe treatment may include a glide, a fringe attached to the glide, and an over edge portion attached to the fringe. The method may include the steps of sliding the glide of the fringe treatment along a cut end of the carpet segment, folding the over edge portions of the fringe over the glide, and attaching the over edge portions to the glide. The method may further include the step of sliding a glide of a second fringe treatment over a second cut end of the carpet segment.

Other features, objects, and advantages of the present invention will become apparent upon review of the following detailed description of the invention when take in conjunction with the drawings and the appended claims.

DETAILED DESCRIPTION OF THE INVENTION

Figure 1:
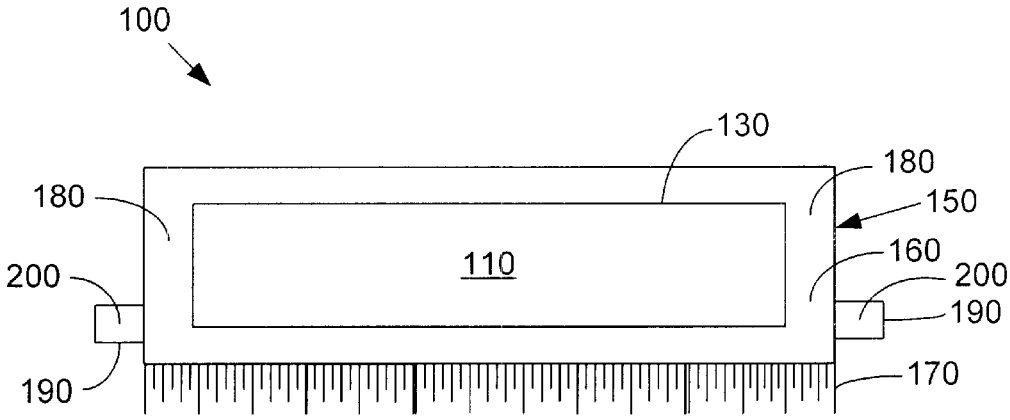
FIG. 1 is a bottom plan view of the fringe treatment of the present invention.
Figure 2:
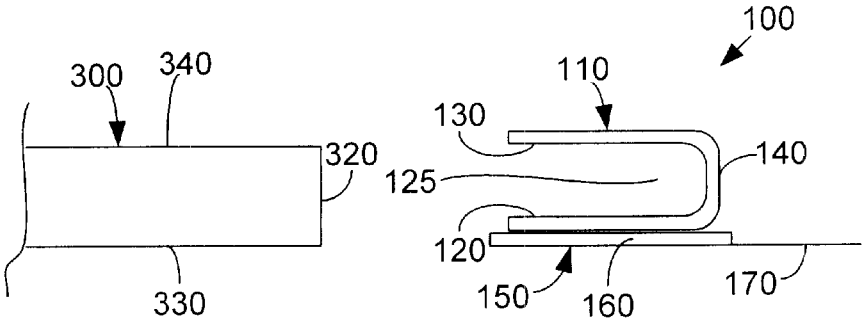
FIG. 2 is an expanded side view of a carpet and the fringe treatment of FIG. 1.

Referring now to the drawings in which like numerals refer to like elements throughout the several views, FIGS. 1 through 6 show a fringe treatment 100 of the present invention. The fringe treatment 100 may include an elongated glide 110. The glide 110 may include a first arm 120 and a second arm 130. The arms 120, 130 may be connected via a joint 140 such that the glide 110 forms a substantial "U" or "V" shape. Each arm 120, 130 may be about an inch (2.54 centimeters) to two inches (5.08 centimeters) in width (i.e., the short direction). The length of each arm 120, 130 (i.e., the long direction) may depend upon the size of the glide 110 as a whole. The glide 110 as a whole may have any predetermined length. The second arm 130 may have a greater width than the first arm 120 because the second arm 130 may not be visible in use. The glide 110 may be made out of a conventional thermoplastic material or a PVC (polyvinyl chloride) material. Other conventional types of materials may be used.

Fixedly attached to the glide 110 may be a fringe 150. The fringe 150 may be of conventional design and may include a base portion 160 joined to a tassel portion 170. The base portion 160 is generally a solidly woven element. The tassel portion 170 may include a plurality of individual tassels extending along the length of the fringe 150. The tassel portion 170 may be of any desired width. The base portion 160 also may be in the form of a bound edge for a carpet such that the tassel portion 170 is not required. The fringe 150 may be made out of conventional carpeting materials of any type. Commonly used materials may include polyester, polypropylene, cotton or similar textiles and materials.

The base portion 160 may be fixedly attached to the first arm 120 of the glide 110 via conventional carpet adhesives. Other conventional types of joiner means may be used, such as hot melt, staples, tapes, hook and loop fasteners, or similar means. The base portion 160 of the fringe 150 preferably covers the first arm 120 of the glide 110 completely so as to eliminate the first arm 120 from view.

The fringe 150 may be slightly longer in length than the glide 110. For example, if the glide 110 is five foot, eight inches (1.7272 meters) in length, the fringe 150 may be six feet (1.8288 meters) in length such that the fringe 150 has an end portion 180 of about two inches (5.08 centimeters) on either side. The end portion 180 preferably includes a piece of double-sided tape 190 with a backing 200 thereon. Alternatively, the end portion 180 may include any conventional type of joiner means, such as hook and loop fasteners or similar means. The consumer may remove the backing 200 from the tape 190 and fold the end portion 180 back over the first arm 120 of the glide 110 so as to secure the glide 110 thereon.

FIGS. 3 through 6 show the use of the fringe treatment 100 with a carpet 300. The carpet 300 may be any conventional type of carpet, rug, mat or similar structure made from any conventional type of materials. The carpet 300 preferably has two parallel bound ends 310 and two parallel cut ends 320. The fringe treatment 100 is intended for use with the two cut ends 320. The carpet 300 generally has a first side 330 and a second side 340. The first side 330 is generally placed on the floor and the second side 340 is generally visible to the consumer. If the length of the carpet 300 is about six feet (1.8288 meters), then the fringe treatment 110 also will be about six feet (1.8288 meters) in length.

Figure 3:
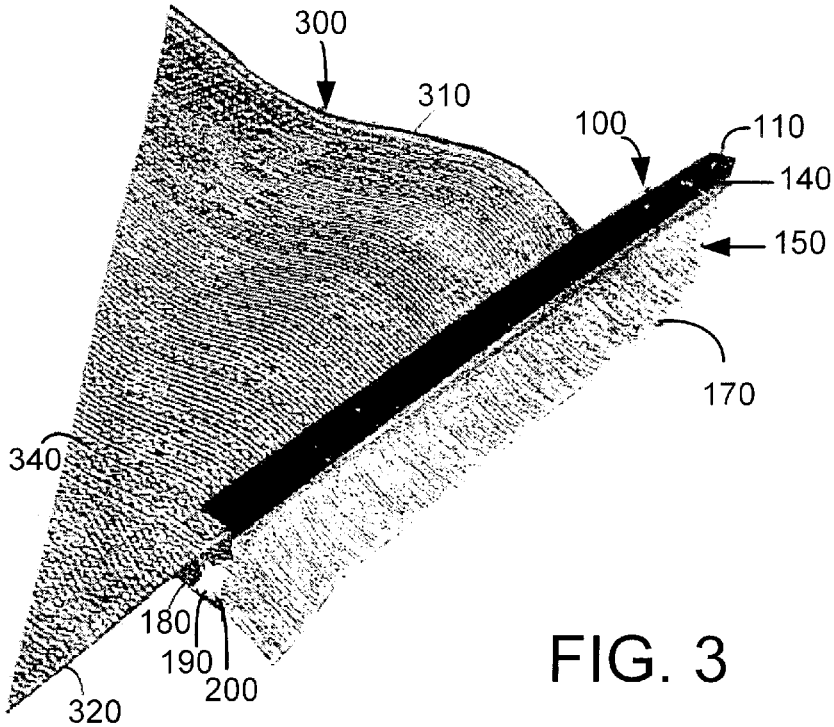
FIG. 3 is a perspective view of the fringe treatment of FIG. 1 being applied to a carpet.

As is shown in FIG. 3, the glide 110 of the fringe treatment 100 is slid along the cut end 320 of the carpet 300. The first arm 120 of the glide 110 with the fringe 150 thereon is slid long the first or the visible side 330 of the carpet 300. The cut end 320 of the carpet 300 thus fills the pocket 125 of the glide 110 in a snug fit.

Figure 4:
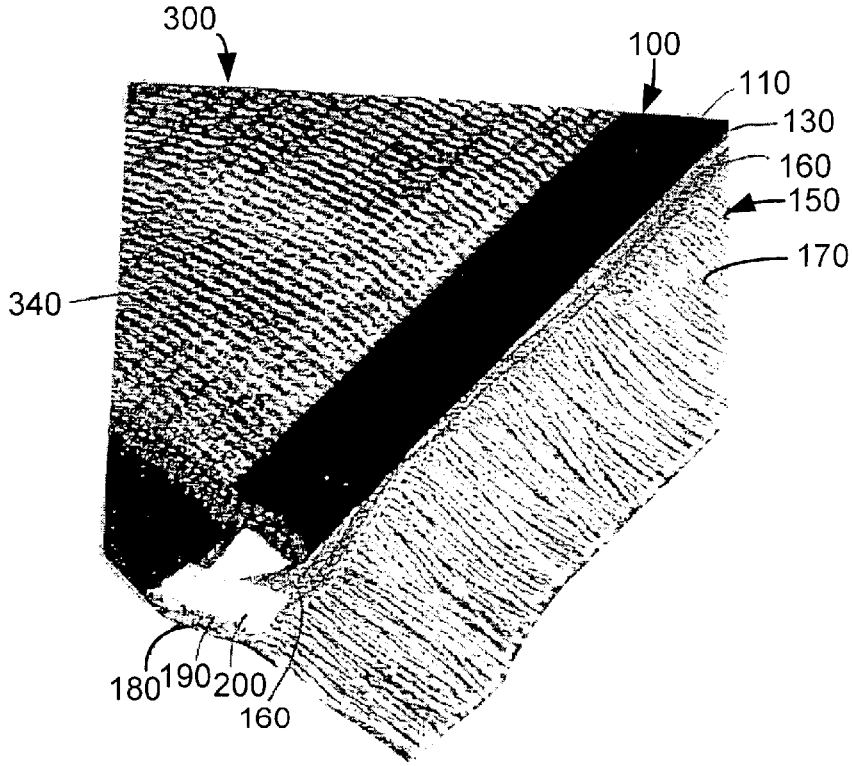
FIG. 4 is a perspective view of the fringe treatment of FIG. 1 applied to a carpet with the end tabs extended.
Figure 5:
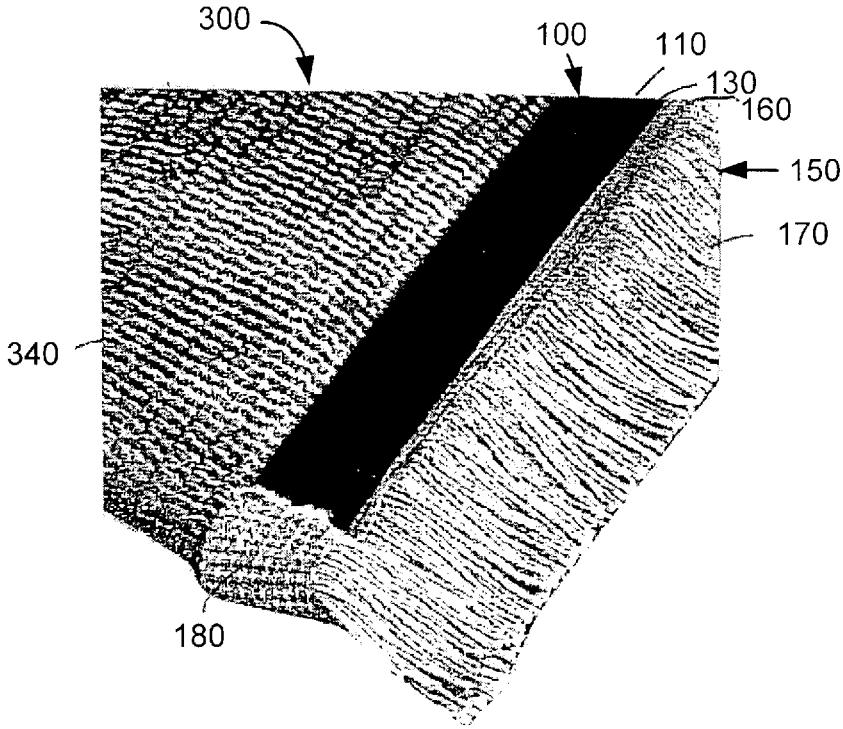
FIG. 5 is a perspective view of the fringe treatment of FIG. 1 applied to a carpet.

Once the glide 110 has been slid along the length of the cut end 320 of the carpet 300, the backing 200 of the tape 190 on the end portions 180 of the fringe 150 may be removed. As is shown in FIGS. 4 and 5, the end portions 180 of the fringe 150 may be folded back upon and taped to the second arm 130 of the glide 110. Another fringe treatment 100 is then placed on the opposite cut end 320 of the carpet 300.

Figure 6:
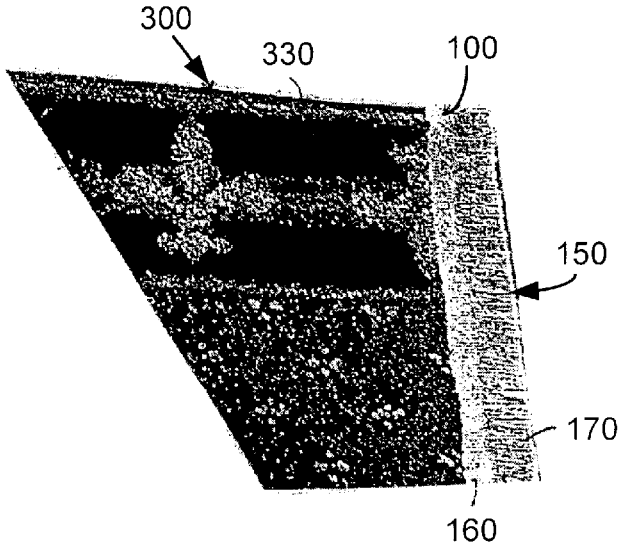
FIG. 6 is a perspective view of a carpet with the fringe treatment of FIG. 1 applied.

The carpet 300 may then be turned on its second side 340 such that the first side 330 and the fringe treatment 100 are visible as is shown in FIG. 6. The present invention thus provides a fringe treatment 100 for a carpet 300 that appears to be a unitary or sewn element.

Numerous alternative embodiments of the present invention are possible. For example, the fringe treatment 100 may have a fringe 150 attached to both the first arm 120 and the second arm 130 of the glide. The fringe treatment 100 thus may be used with a carpet 300 intended for use on either the first side 330 or the second side 340. A further embodiment may include the use of a fringe treatment 100 on any or all of the four ends 310, 320 of the carpet 300.

It is anticipated that a plurality of fringe treatments 110, with varying types of fringes 150 positioned thereon, will be available for use with the carpet 300. Various lengths of the fringe treatments 110 may be available for use with various lengths of the carpeting 300. The fringe treatment 110 also may be easily removed from the carpet 300. A fringe treatment 110 with a different type of fringe 150 positioned thereon may then be used with the carpet 300. The fringe treatment 100 may be applied at the commercial outlet or applied by the consumer.

It should be understood that the foregoing relates only to the preferred embodiments of the present invention and that numerous changes may be made herein without departing from the spirit and scope of the invention as defined by the following appended claims.

We claim:

1. A fringe treatment for an edge of a carpet, comprising:

a glide;

said glide comprising a substantial U-shape such that said glide can accommodate said edge of said carpet in a snug fit, wherein said snug fit is provided by the glide; and a fringe;

said fringe comprising a base portion attached to said glide and a plurality of tassels connected to said base portion.

2. The fringe treatment of claim 1, wherein said glide comprises a first arm and a second arm.

3. The fringe treatment of claim 2, wherein said fringe is attached to said first arm of said glide.

4. The fringe treatment of claim 3, further comprising a second fringe, said second fringe attached to said second arm of said glide.

5. The fringe treatment of claim 2, wherein said first arm and said second arm each comprise a width of about one to two inches.

6. The fringe treatment of claim 2, wherein said second arm of said glide comprises a width of greater dimension than a width of said first arm of said glide.

7. The fringe treatment of claim 2, wherein said fringe covers said first arm of said glide.

8. The fringe treatment of claim 1, wherein said glide comprises a thermoplastic.

9. The fringe treatment of claim 1, wherein said fringe comprises polyester.

10. The fringe treatment of claim 1, wherein said fringe is fixedly attached to said base via an adhesive.

11. The fringe treatment of claim 1, wherein said fringe is removably attached via hook and loop fasteners.

12. The fringe treatment of claim 1, wherein said fringe comprises a first end portion and a second end portion.

13. The fringe treatment of claim 12, wherein said first and said second end portions of said fringe both comprise a length of tape such that said first and said second end portions can fold over said glide and be attached thereto by said length of tape.

* * * * *